United States Patent [19]

Sine

[11] 4,266,778

[45] May 12, 1981

[54] BALL PROJECTING AND CATCHING APPARATUS

[76] Inventor: William A. Sine, 332 Upland Ave., Clarksburg, W. Va. 26301

[21] Appl. No.: 77,316

[22] Filed: Sep. 20, 1979

[51] Int. Cl.[3] ..... A63B 65/12

[52] U.S. Cl. ..... 273/324; 124/79

[58] Field of Search ..... 273/324; 124/79

[56] References Cited

U.S. PATENT DOCUMENTS

| | | | |
|---|---|---|---|
| 898,350 | 9/1908 | Foster | 273/324 |
| 2,193,441 | 3/1940 | Batkin | 273/324 |
| 2,201,802 | 5/1940 | Steiner | 273/324 |
| 4,234,183 | 11/1980 | Stephens | 273/318 |

*Primary Examiner*—Anton O. Oechsle

*Attorney, Agent, or Firm*—Buell, Blenko, Ziesenheim & Beck

[57] ABSTRACT

A game apparatus for repeatedly catching and relaunching a ball into the air comprises a pair of congruent straps with the ends superposed for grasping in the player's hands. Stacking the straps creates a separation between their intermediate portions so that with the exercise of some skill a ball in flight may be allowed to pass through an opening in the upper strap and caught on a hole in the lower strap. Upon smartly drawing the straps taut, the ball is relaunched. Attached to the upper strap is a frusto-conical shell axially aligned with the holes in the straps which increases the ease with which the ball may be intercepted.

6 Claims, 2 Drawing Figures

BALL PROJECTING AND CATCHING APPARATUS

This invention relates to game apparatus and more particularly to a device for repeatedly catching and relaunching a ball into the air.

Game devices have been heretofore devised permitting the repeated catching and relaunching of a ball. The present invention is of a similar nature, however employing novel structure and materials.

A primary object of the present invention is to provide amusement and pleasure to a player utilizing the invention.

Another object of my present invention is to provide an apparatus which requires manual, moderately skillful operation of a challenging nature.

Yet another object of my present invention is to provide an apparatus for developing or increasing visual-motor coordination.

Still another object of my invention is to provide game apparatus of the indicated nature which is inexpensive to manufacture, compact to store and durable. Other objects of my present invention, together with some of the advantageous features thereof, will appear from the following description of a preferred embodiment which is illustrated in the accompanying drawings. It is to be understood, however, that I am not to be limited to the precise embodiment illustrated nor to the precise arrangement or shape of the various component parts thereof, as my invention, as defined in the appended claims, can be embodied in a plurality and variety of forms.

SUMMARY OF THE INVENTION

The invention comprises a pair of superposed congruent straps. The ends of the straps are adapted for grasping in the player's hands, in part by having the contiguous surfaces of the left ends joined and the right ends similarly joined. Through the appropriate center of the intermediate portion of the lower strap is an opening somewhat smaller than the playing ball, wherein the ball may be caught and retained. In the upper strap, aligned with the opening in the lower strap, is an opening which is somewhat larger than the ball. A rigid frusto-conical shell is attached by its smaller circular periphery to the upper surface of the upper strap exactly aligned with the openings in the straps. With the straps slackened, a separation is created between their intermediate portions whereby the ball while freely falling can be intercepted in the shell, passed through the opening in the upper strap and caught on the opening in the lower strap. By pulling the straps taut, the ball is then relaunched into the air.

DESCRIPTION OF THE PREFERRED EMBODIMENT

Figure 1:
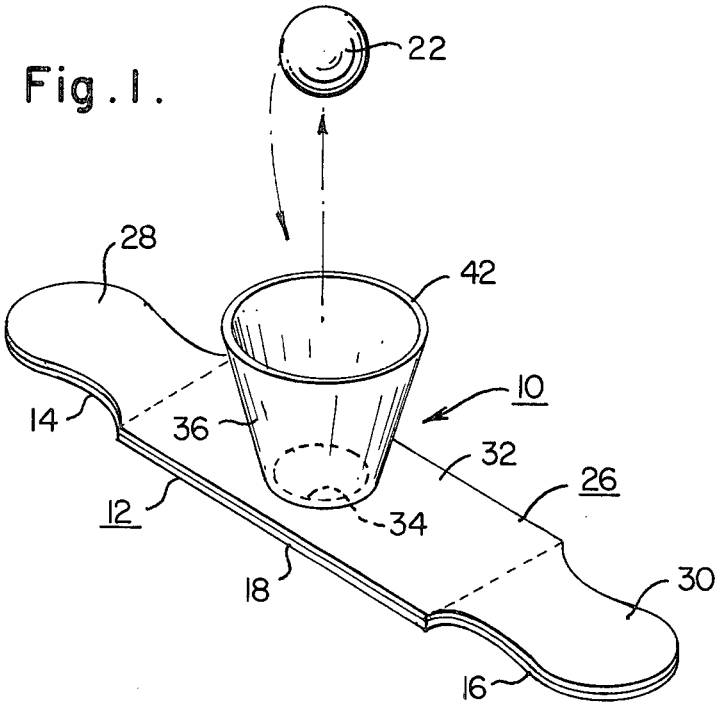
FIG. 1 is an axanometric view of a preferred embodiment of the present invention with the straps drawn taut, and illustrating as well, a ball in flight after being relaunched from the apparatus.

As shown in the drawings, the apparatus 10 comprises a lowerstrap 12 having a left end 14, a right end 16 and an intermediate portion 18. In the approximate center of the broad surface of the intermediate portion 18 is a circular opening 20 having a diameter smaller than that of a ball 22 employed in playing, so that the ball 22 can be brought to rest on the opening. The rim of the opening 20 is reinforced by the insertion of a grommet 24.

Congruent with the lower strap 12 is an upper strap 26 also having a left end 28, a right end 30 and an intermediate portion 32. The straps 12 and 26 are conveniently fabricated from leather, plastic or a similar flexible material. Leather, of course, is a non-elastic material. The left ends 14 and 28 are superposed and joined as by being sewed, molded or glued together. The right ends 16 and 30 are also superposed and joined in a similar manner. In the intermediate portion 32 of the upper strap 26 is an opening 34 axially aligned with the opening 20 in the lower strap 12. This opening 34 is of a diameter larger than the diameter of the ball 22.

A rigid frusto-conical shell 36 is attached by its smaller circular periphery 38 to the top surface of the upper strap 26. The shell 36 is axially aligned with the openings 20 and 34 in the straps and the diameter of the smaller circular periphery 38 of the shell 36 is larger than the diameter of the ball 22. The rim of the opening 34 in the upper strap 26 is reinforced by a grommet 40 also serving to retain the smaller circular periphery 38 of the shell 36.

Suitable approximate dimensions for the straps 12 and 26 are a width of 2 inches, an overall length of 14 inches and a length of 4 inches for each end 15 and 16. With a ball 22 approximately $\frac{3}{4}$ of an inch in diameter, a preferred diameter for the opening 20 in the lower strap 12 is $\frac{5}{8}$ inches. The shell 36 preferably has a height of $1\frac{1}{2}$ inches, a smaller circular periphery 38 with a diameter of 1 inch, and a larger circular periphery 42 with a diameter of $1\frac{3}{4}$ inches. The ball 22 can be of rubber, plastic, cork, wood or similar suitable material.

Figure 2:
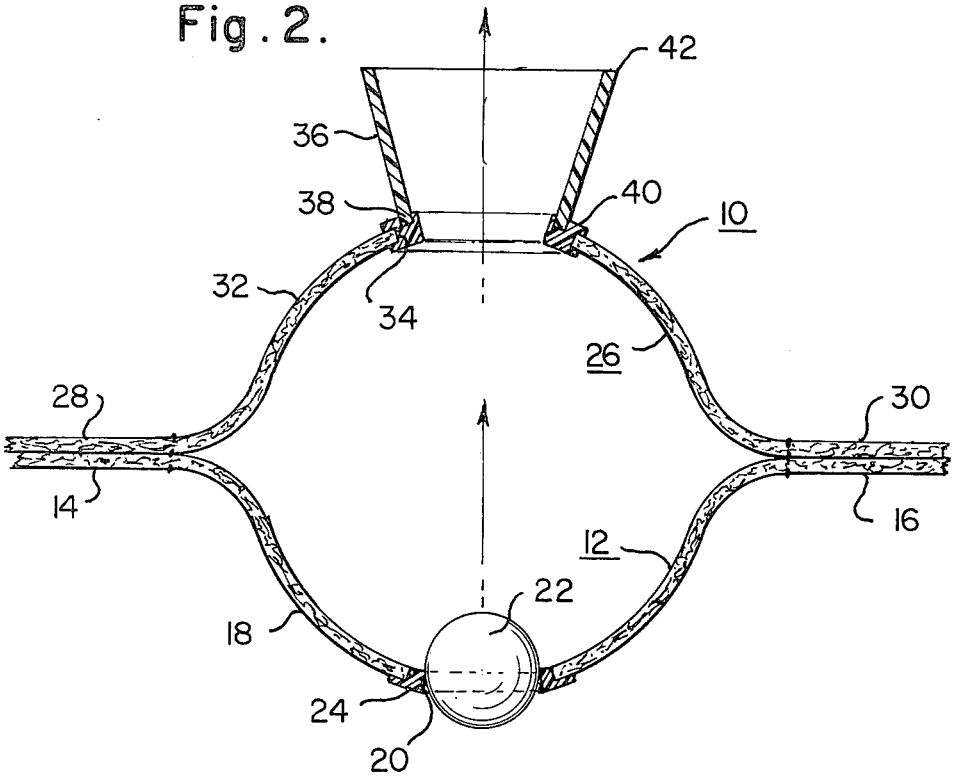
FIG. 2 is a site elevation view of the preferred embodiment shown in the catching state as produced by bringing the ends of the straps closer to each other, and illustrating, as will the ball in repose within the apparatus.

In using the described apparatus 10, the player grasps the ends 14 and 16, maintaining them in an approximately horizontal position. By bringing the ends 14 and 16 near each other to provide slack in the straps 12 and 26, a separation 44 is formed between the intermediate portions 18 and 32 as shown in FIG. 2. The apparatus 10 can then be oriented to allow the ball 22 in descending flight to enter the shell 36, pass through the opening 34 in the upper strap 26, and be caught in the opening 20 in the lower strap 12. Upon briskly drawing the straps taut as shown in FIG. 1, the ball 22 is relaunched into the air. One or more players with duplicate equipment can engage in play, volleying a ball amongst themselves.

while one preferred embodiment of the invention has been described and shown, it is to be understood that modifications as to materials, form, arrangement, and use of parts may be made without departing from the scope and spirit of the invention as claimed.

I claim:

1. For a player to engage in games with a ball, apparatus comprising:

a lower non-elastic flexible strap having left and right ends and an intermediate portion having substantially in the center thereof an opening of diameter smaller than the diameter of the ball;

an upper non-elastic flexible strap having left and right ends and an intermediate portion, the broad surfaces of said strap being congruent with the broad surfaces of the lower strap, said upper strap having an opening of diameter larger than the diameter of the ball, said opening being axially aligned with the opening in the lower strap, the ends of the upper strap being superposed upon the corresponding ends of the lower strap so that the player upon holding said left ends near said right ends produces a separation between the intermediate portions of the straps, whereupon the ball in descending flight may be allowed to pass through the opening in the upper strap and be caught on the opening in the lower strap, and subsequently, by pulling said left ends away from said right ends, the ball will be relaunched through the opening in the upper strap and into the air.

2. The invention as in claim 1, further comprising a frusto-conical shell having its smaller circular periphery larger than the diameter of the ball, said periphery being joined to the upper surface of the upper strap concentrically with the opening in the upper strap.

3. The invention as in claim 1 further comprising a rigid rim around the opening in the upper strap.

4. The invention as in claim 1 further comprising a rigid rim around the opening in the lower strap.

5. The invention as in claim 1, wherein the corresponding ends of the upper and lower straps are joined along their superposed surfaces.

6. The invention as in claim 2 further comprising a rigid rim around the opening in the upper strap, and a rigid rim around the opening in the lower strap, and wherein the corresponding ends of the upper and lower straps are joined along their superposed surfaces.

* * * * *